US010584536B2

(12) United States Patent
Viens

(10) Patent No.: US 10,584,536 B2
(45) Date of Patent: Mar. 10, 2020

(54) APPARATUS, SYSTEMS, AND METHODS FOR EFFICIENTLY COMMUNICATING A GEOSTEERING TRAJECTORY ADJUSTMENT

(71) Applicant: Nabors Drilling Technologies USA, Inc., Houston, TX (US)

(72) Inventor: Christopher Viens, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 226 days.

(21) Appl. No.: 15/797,444

(22) Filed: Oct. 30, 2017

(65) Prior Publication Data

US 2019/0128067 A1 May 2, 2019

(51) Int. Cl.

| | |
|---|---|
| ***E21B 7/04*** | (2006.01) |
| ***E21B 47/022*** | (2012.01) |
| ***E21B 47/024*** | (2006.01) |
| ***E21B 44/00*** | (2006.01) |
| ***E21B 47/18*** | (2012.01) |
| ***E21B 49/00*** | (2006.01) |
| ***E21B 41/00*** | (2006.01) |

(52) U.S. Cl.

CPC ..... *E21B 7/04* (2013.01); *E21B 44/00* (2013.01); *E21B 47/022* (2013.01); *E21B 47/024* (2013.01); *E21B 47/18* (2013.01); *E21B 49/00* (2013.01)

(58) Field of Classification Search

CPC ..... E21B 7/04; E21B 47/022; E21B 44/00; E21B 47/024; E21B 47/18; E21B 49/00; E21B 7/10

See application file for complete search history.

(56) References Cited

U.S. PATENT DOCUMENTS

| | | | | |
|---|---|---|---|---|
| 6,523,623 | B1 | 2/2003 | Schuh | |
| 7,359,845 | B2 | 4/2008 | Kelfoun | |
| 9,043,154 | B2 | 5/2015 | Luxey | |
| 2007/0044536 | A1 | 3/2007 | Gunsaulis | |
| 2014/0135995 | A1 | 5/2014 | Samuel | |
| 2015/0331971 | A1* | 11/2015 | Scollard | E21B 43/30 703/1 |
| 2017/0089140 | A1 | 5/2017 | Shaw | |
| 2018/0266245 | A1 | 9/2018 | Gillan et al. | |
| 2019/0078427 | A1 | 3/2019 | Gillan | |

* cited by examiner

*Primary Examiner* — Wei Wang

(74) *Attorney, Agent, or Firm* — Haynes and Boone, LLP

(57) ABSTRACT

Apparatus, systems, and methods according to which a geosteering trajectory change is efficiently communicated by presenting, on a first human-machine interface, a plurality of selectable trajectory types, each of the trajectory types representing a potential trajectory of a wellbore, selecting, via the first human-machine interface, the selectable trajectory type most closely representing a desired trajectory of the wellbore, the selected trajectory type including one or more data fields adapted to receive one or more task parameters needed to drill the wellbore along the desired trajectory, entering, via the first human-machine interface, the one or more task parameters into the one or more data fields of the selected trajectory type, and pushing the selected trajectory type and/or the one or more entered task parameters to a control system adapted to control drilling equipment to drill the wellbore along the desired trajectory.

19 Claims, 8 Drawing Sheets

166

| TIME SENT (CLIENT) | TIME RECEIVED (RIG) | 160 INTENDED EFFECTIVE DEPTH | 162 ACTUAL EFFECTIVE DEPTH | USER | 120(a), (b), (c), OR (d) TRAJECTORY TYPE | STRING |
|---|---|---|---|---|---|---|
| XXXXX | XXXXX | 10000 | 10001 | J. DOE | DIP HOLD | INC: 92 |
| XXXXXX | XXXXXX | 11543 | 11543 | P. SMITH | TARGET POINT | MD: TVD: |
| XXXXXX | XXXXXX | 12400 | 12432 | H. GUIDRY | WINDOW SHIFT | UP: DOWN: LEFT: RIGHT: |
| XXXXXX | XXXXXX | 14324 | 14543 | J. DOE | PLAN CHANGE | INFLECTION 1,2,3,4 |

APPARATUS, SYSTEMS, AND METHODS FOR EFFICIENTLY COMMUNICATING A GEOSTEERING TRAJECTORY ADJUSTMENT

TECHNICAL FIELD

The present disclosure relates generally to oil and gas drilling and production operations, and, more particularly, to a geosteering trajectory change communication apparatus, system, and method.

BACKGROUND

At the outset of a drilling operation, drillers typically establish a well plan that includes a steering objective location (or target location) and a drilling path to the steering objective location. The well plan may be based on a subsurface model developed from surface testing (e.g., seismic or otherwise) and/or data gathered from wells adjacent to the drilling location. Once drilling commences, a bottom-hole assembly (BHA) may be directed or "steered" from a vertical drilling path (in any number of directions) to follow the proposed well plan. For example, to recover an underground hydrocarbon deposit, a well plan might include a vertical bore to the side of a reservoir containing a deposit, then a directional or horizontal bore that penetrates the deposit. The operator may then follow the plan by steering the BHA through the vertical and horizontal aspects in accordance with the plan.

Due to the difficulty in measuring subsurface lithology prior to the drilling of a well, the well plan may need to be adjusted as the well is drilled closer to the target location—such adjustments may be made based on data received from measurement-while-drilling (MWD) tool(s) and/or logging-while-drilling (LWD) tool(s) of the BHA. The MWD and LWD tool(s) take periodic surveys allowing operators to assess whether the BHA (and therefore the drill-bore itself) is substantially following the well plan. The process of "geosteering" involves making trajectory adjustments by analyzing data from the MWD and LWD tool(s) to determine where the preferred zone of the formation is actually located. If the geosteerer determines that the well trajectory needs to be changed, the recommended change must be effectively communicated to the rig personnel or operator(s) at the well site so the target location can be changed accordingly. Therefore, what is needed is an apparatus, system, and/or method that addresses one or more of the foregoing issues, and/or one or more other issues.

BRIEF DESCRIPTION OF THE DRAWINGS

FIG. 5(*b*) is a graphical illustration of at least a portion of the second selectable trajectory type of FIG. 4, according to one or more embodiments of the present disclosure.

FIG. 5(*c*) is a graphical illustration of at least a portion of the third selectable trajectory type of FIG. 4, according to one or more embodiments of the present disclosure.

FIG. 5(*d*) is a graphical illustration of at least a portion of the fourth selectable trajectory type of FIG. 4, according to one or more embodiments of the present disclosure.

FIG. 7(*b*) is a flow diagram of steps that may be, include, or be part of at least a portion of the method of FIG. 7(*a*), according to one or more embodiments of the present disclosure.

FIG. 7(*c*) is a flow diagram of further steps that may be, include, or be part of at least a portion of the method of FIG. 7(*a*), according to one or more embodiments of the present disclosure.

FIG. 7(*d*) is a flow diagram of still further steps that may be, include, or be part of at least a portion of the method of FIG. 7(*a*), according to one or more embodiments of the present disclosure.

DETAILED DESCRIPTION

Figure 1:
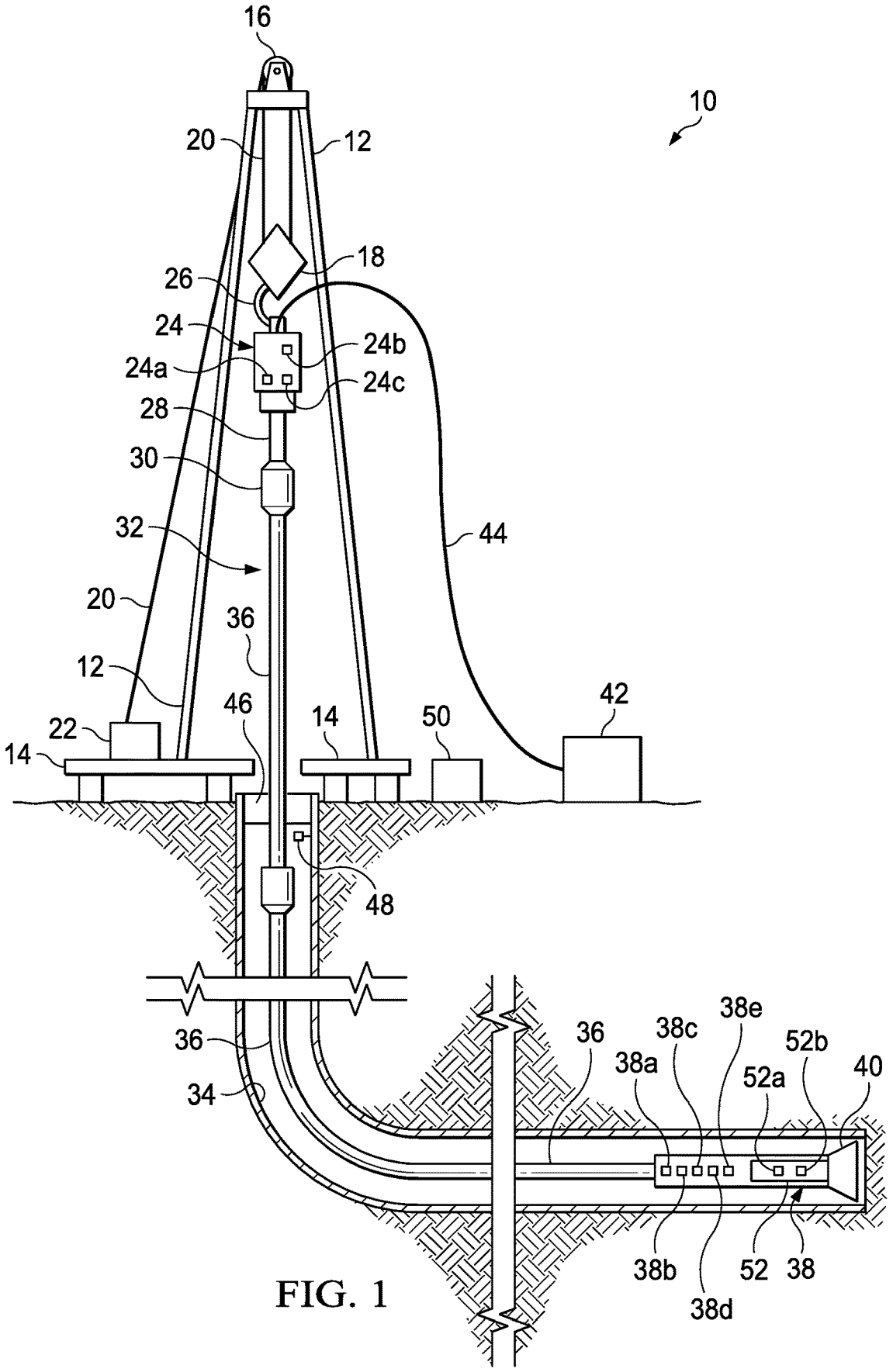
FIG. 1 is an elevational/schematic view of a drilling rig, according to one or more embodiments of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure aims to facilitate the effective communication of a desired well trajectory from a geosteerer (e.g., a geosteering system user, such as a geologist located remote from drilling equipment) to a control system of the drilling equipment, a driller at or near the drilling equipment, and/or any combination thereof. While conventional systems relay well trajectory changes through a complex and tedious review and approval process before implementation (often by word of mouth, email, or telephone communications among rig personnel, the geosteerer, and others), the apparatus, systems, and methods herein allow for much faster and more efficient implementation of a desired well trajectory by facilitating communication of said trajectory directly between the geosteerer and the control system of the drilling equipment, the driller tasked with operating the drilling equipment (e.g., via the control system), and/or any combination thereof. To this end, a systematic approach is disclosed for optimizing the manner in which the desired well trajectory is communicated from the geosteerer (or another person having authority over well trajectory changes) to the drilling equipment's control system and/or the driller.

Referring to FIG. 1, an embodiment of a drilling rig (a.k.a., drilling equipment) for implementing the aims of the present disclosure is schematically illustrated and generally referred to by the reference numeral 10. The drilling rig 10 is or includes a land-based drilling rig—however, one or more aspects of the present disclosure are applicable or readily adaptable to any type of drilling rig (e.g., a jack-up rig, a semisubmersible, a drill ship, a coiled tubing rig, a well service rig adapted for drilling and/or re-entry operations, and a casing drilling rig, among others). The drilling rig 10 includes a mast 12 that supports lifting gear above a rig floor 14, which lifting gear includes a crown block 16 and a traveling block 18. The crown block 16 is coupled to the mast 12 at or near the top of the mast 12. The traveling block 18 hangs from the crown block 16 by a drilling line 20. The drilling line 20 extends at one end from the lifting gear to drawworks 22, which drawworks 22 are configured to reel out and reel in the drilling line 20 to cause the traveling block 18 to be lowered and raised relative to the rig floor 14. The other end of the drilling line 20 (known as a dead line anchor) is anchored to a fixed position, possibly near the drawworks 22 (or elsewhere on the rig).

The drilling rig 10 further includes a top drive 24, a hook 26, a quill 28, a saver sub 30, and a drill string 32. The top drive 24 is suspended from the hook 26, which hook is attached to the bottom of the traveling block 18. The quill 28 extends from the top drive 24 and is attached to a saver sub 30, which saver sub is attached to the drill string 32. The drill string 32 is thus suspended within a wellbore 34. The quill 28 may instead be attached directly to the drill string 32. The term "quill" as used herein is not limited to a component which directly extends from the top drive 24, or which is otherwise conventionally referred to as a quill 28. For example, within the scope of the present disclosure, the "quill" may additionally (or alternatively) include a main shaft, a drive shaft, an output shaft, and/or another component which transfers torque, position, and/or rotation from the top drive 24 or other rotary driving element to the drill string 32, at least indirectly. Nonetheless, albeit merely for the sake of clarity and conciseness, these components may be collectively referred to herein as the "quill."

The drill string 32 includes interconnected sections of drill pipe 36, a bottom-hole assembly ("BHA") 38, and a drill bit 40. The BHA 38 may include stabilizers, drill collars, and/or measurement-while-drilling ("MWD") or wireline conveyed instruments, among other components. The drill bit 40 is connected to the bottom of the BHA 38 or is otherwise attached to the drill string 32. One or more mud pumps 42 deliver drilling fluid to the drill string 32 through a hose or other conduit 44, which conduit may be connected to the top drive 24. The downhole MWD or wireline conveyed instruments may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, and downloaded from the instrument(s) at the surface and/or transmitted in real-time or delayed time to the surface. Data transmission methods may include, for example, digitally encoding data and transmitting the encoded data to the surface as pressure pulses in the drilling fluid or mud system. The MWD tools and/or other portions of the BHA 38 may have the ability to store measurements for later retrieval via wireline and/or when the BHA 38 is tripped out of the wellbore 34.

The drilling rig 10 may also include a rotating blow-out preventer ("BOP") 46, such as if the wellbore 34 is being drilled utilizing under-balanced or managed-pressure drilling methods. In such an embodiment, the annulus mud and cuttings may be pressurized at the surface, with the actual desired flow and pressure possibly being controlled by a choke system, and the fluid and pressure being retained at the well head and directed down the flow line to the choke system by the rotating BOP 46. The drilling rig 10 may also include a surface casing annular pressure sensor 48 configured to detect the pressure in the annulus defined between, for example, the wellbore 34 (or casing therein) and the drill string 32. In the embodiment of FIG. 1, the top drive 24 is utilized to impart rotary motion to the drill string 32. However, aspects of the present disclosure are also applicable or readily adaptable to embodiments utilizing other drive systems, such as a power swivel, a rotary table, a coiled tubing unit, a downhole motor, and/or a conventional rotary rig, among others.

The drilling rig 10 also includes a control system 50 configured to control or assist in the control of one or more components of the drilling rig 10—for example, the control system 50 may be configured to transmit operational control signals to the drawworks 22, the top drive 24, the BHA 38 and/or the mud pump(s) 42. The control system 50 may be a stand-alone component installed near the mast 12 and/or other components of the drilling rig 10. In some embodiments, the control system 50 includes one or more systems located in a control room proximate the drilling rig 10, such as the general purpose shelter often referred to as the "doghouse" serving as a combination tool shed, office, communications center, and general meeting place. The control system 50 may be configured to transmit the operational control signals to the drawworks 22, the top drive 24, the BHA 38, and/or the mud pump(s) 42 via wired or wireless transmission (not shown). The control system 50 may also be configured to receive electronic signals via wired or wireless transmission (also not shown) from a variety of sensors included in the drilling rig 10, where each sensor is configured to detect an operational characteristic or parameter. The sensors from which the control system 50 is configured to receive electronic signals via wired or wireless transmission (not shown) may include one or more of the following: a torque sensor 24*a*, a speed sensor 24*b*, a WOB sensor 24*c*, a downhole annular pressure sensor 38*a*, a shock/vibration sensor 38*b*, a toolface sensor 38*c*, a WOB sensor 38*d*, the surface casing annular pressure sensor 48, a mud motor delta pressure ("ΔP") sensor 52*a*, and one or more torque sensors 52*b*.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data. The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the drilling rig 10.

The drilling rig 10 may include any combination of the following: the torque sensor 24*a*, the speed sensor 24*b*, and the WOB sensor 24*c*. The torque sensor 24*a* is coupled to or otherwise associated with the top drive 24—however, the torque sensor 24*a* may alternatively be located in or associated with the BHA 38. The torque sensor 24*a* is configured to detect a value (or range) of the torsion of the quill 28 and/or the drill string 32 in response to, for example, operational forces acting on the drill string 32. The speed sensor 24*b* is configured to detect a value (or range) of the rotational speed of the quill 28. The WOB sensor 24*c* is coupled to or otherwise associated with the top drive 24, the drawworks 22, the crown block 16, the traveling block 18, the drilling line 20 (which includes the dead line anchor), or another component in the load path mechanisms of the drilling rig 10. More particularly, the WOB sensor 24*c* includes one or more sensors different from the WOB sensor 38*d* that detect and calculate weight-on-bit, which can vary from rig to rig (e.g., calculated from a hook load sensor based on active and static hook load).

Further, the drilling rig 10 may additionally (or alternatively) include any combination of the following: the downhole annular pressure sensor 38*a*, the shock/vibration sensor 38*b*, the toolface sensor 38*c*, and the WOB sensor 38*d*. The downhole annular pressure sensor 38*a* is coupled to or otherwise associated with the BHA 38, and may be configured to detect a pressure value or range in the annulus-shaped region defined between the external surface of the BHA 38 and the internal diameter of the wellbore 34 (also referred to as the casing pressure, downhole casing pressure, MWD casing pressure, or downhole annular pressure). Such measurements may include both static annular pressure (i.e., when the mud pump(s) 42 are off) and active annular pressure (i.e., when the mud pump(s) 42 are on). The shock/vibration sensor 38*b* is configured for detecting shock and/or vibration in the BHA 38. The toolface sensor 38*c* is configured to detect the current toolface orientation of the drill bit 40, and may be or include a magnetic toolface sensor which detects toolface orientation relative to magnetic north or true north. In addition, or instead, the toolface sensor 38*c* may be or include a gravity toolface sensor which detects toolface orientation relative to the Earth's gravitational field. In addition, or instead, the toolface sensor 38*c* may be or include a gyro sensor. The WOB sensor 38*d* may be integral to the BHA 38 and is configured to detect WOB at or near the BHA 38.

Further still, the drilling rig 10 may additionally (or alternatively) include a MWD survey tool 38*e* at or near the BHA 38. In some embodiments, the MWD survey tool 38*e* includes any of the sensors 38*a*-38*d* as well as combinations of these sensors. The BHA 38 and the MWD portion of the BHA 38 (which portion includes the sensors 38*a-d* and the MWD survey tool 38*e*) may be collectively referred to as a "downhole tool." Alternatively, the BHA 38 and the MWD portion of the BHA 38 may each be individually referred to as a "downhole tool." The MWD survey tool 38*e* may be configured to perform surveys along length of a wellbore, such as during drilling and tripping operations. The data from these surveys may be transmitted by the MWD survey tool 38*e* to the control system 50 through various telemetry methods, such as mud pulses. In addition, or instead, the data from the surveys may be stored within the MWD survey tool 38*e* or an associated memory. In this case, the survey data may be downloaded to the control system 50 when the MWD survey tool 38*e* is removed from the wellbore or at a maintenance facility at a later time. The MWD survey tool 38*e* is discussed further below with reference to FIG. 2.

Finally, the drilling rig 10 may additionally (or alternatively) include any combination of the following: the mud motor ΔP sensor 52*a* and the torque sensor(s) 52*b*. The mud motor ΔP sensor 52*a* is configured to detect a pressure differential value or range across one or more motors 52 of the BHA 38 and may comprise one or more individual pressure sensors and/or a comparison tool. The motor(s) 52 may each be or include a positive displacement drilling motor that uses hydraulic power of the drilling fluid to drive the drill bit 40 (also known as a mud motor). The torque sensor(s) 52*b* may also be included in the BHA 38 for sending data to the control system 50 that is indicative of the torque applied to the drill bit 40 by the motor(s) 52.

Figure 2:
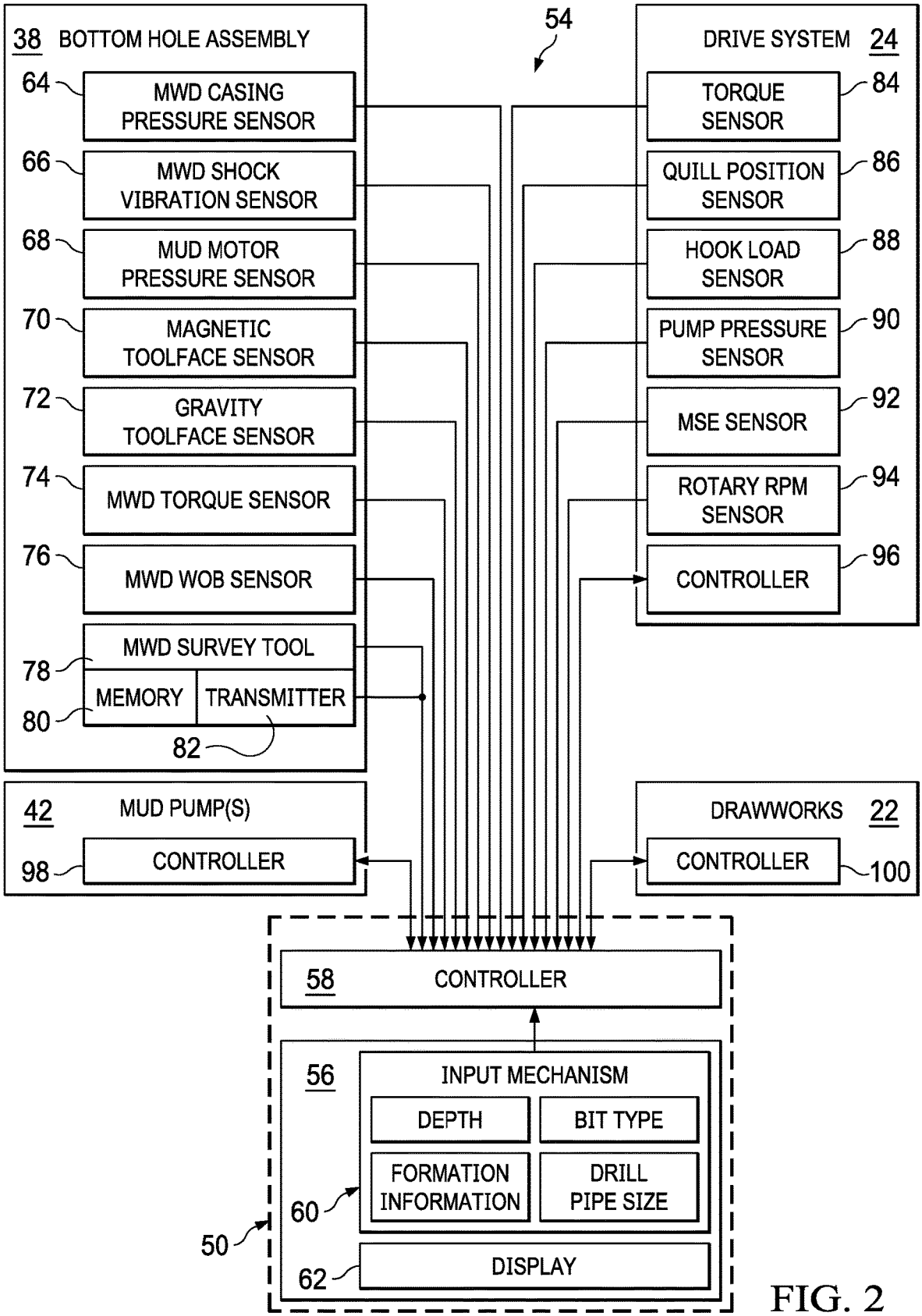
FIG. 2 is a diagrammatic illustration of an apparatus that may be implemented within the environment and/or the drilling rig of FIG. 1, according to one or more embodiments of the present disclosure.

Referring to FIG. 2, an apparatus is diagrammatically shown and generally referred to by the reference numeral 54. The apparatus 54 includes at least respective parts of the drilling rig 10, including, but not limited to, the control system 50, the drawworks 22, the top drive 24 (identified as a "drive system"), the BHA 38, and the mud pump(s) 42. The apparatus 54 may be implemented within the environment and/or the drilling rig 10 of FIG. 1. The drilling rig 10 and the apparatus 54 may be collectively referred to as a "drilling system." As shown in FIG. 2, the control system 50 includes a user-interface 56 and a controller 58—depending on the embodiment, these may be discrete components that are interconnected via a wired or wireless link. The user-interface 56 and the controller 58 may additionally (or alternatively) be integral components of a single system. The user-interface 56 may include an input mechanism 60 that permits a user to input drilling settings or parameters such as, for example, left and right oscillation revolution settings (these settings control the drive system to oscillate a portion of the drill string 32), acceleration, toolface setpoints, rotation settings, a torque target value (such as a previously calculated torque target value that may determine the limits of oscillation), information relating to the drilling parameters of the drill string 32 (such as BHA information or arrangement, drill pipe size, bit type, depth, and formation information), and/or other setpoints and input data.

The input mechanism 60 may include a keypad, voice-recognition apparatus, dial, button, switch, slide selector, toggle, joystick, mouse, database, and/or any other suitable data input device. The input mechanism 60 may support data input from local and/or remote locations. In addition, or instead, the input mechanism 60, when included, may permit user-selection of predetermined profiles, algorithms, setpoint values or ranges, such as via one or more drop-down menus—this data may instead (or in addition) be selected by the controller 58 via the execution of one or more database look-up procedures. In general, the input mechanism 60 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other suitable techniques or systems. The user-interface 56 may also include a display 62 for visually presenting information to the user in textual, graphic, or video form. The display 62 may be utilized by the user to input drilling parameters, limits, or setpoint data in conjunction with the input mechanism 60—for example, the input mechanism 60 may be integral to or otherwise communicably coupled with the display 62. The controller 58 may be configured to receive data or information from the user, the drawworks 22, the top drive 24, the BHA 38, and/or the mud pump(s) 42—the controller 58 processes such data or information to enable effective and efficient drilling.

The BHA 38 includes one or more sensors (typically a plurality of sensors) located and configured about the BHA 38 to detect parameters relating to the drilling environment, the condition and orientation of the BHA 38, and/or other information. For example, the BHA 38 may include an MWD casing pressure sensor 64, an MWD shock/vibration sensor 66, a mud motor ΔP sensor 68, a magnetic toolface sensor 70, a gravity toolface sensor 72, an MWD torque sensor 74, and an MWD weight-on-bit ("WOB") sensor 76—in some embodiments, one or more of these sensors is, includes, or is part of the following sensor(s) shown in FIG. 1: the downhole annular pressure sensor 38*a*, the shock/vibration sensor 38*b*, the toolface sensor 38*c*, the WOB sensor 38*d*, the mud motor ΔP sensor 52*a*, and/or the torque sensor(s) 52*b*.

The MWD casing pressure sensor 64 is configured to detect an annular pressure value or range at or near the MWD portion of the BHA 38. The MWD shock/vibration sensor 66 is configured to detect shock and/or vibration in the MWD portion of the BHA 38. The mud motor ΔP sensor 68 is configured to detect a pressure differential value or range across the mud motor of the BHA 38. The magnetic toolface sensor 70 and the gravity toolface sensor 72 are cooperatively configured to detect the current toolface. In some embodiments, the magnetic toolface sensor 70 is or includes a magnetic toolface sensor that detects toolface orientation relative to magnetic north or true north. In some embodiments, the gravity toolface sensor 72 is or includes a gravity toolface sensor that detects toolface orientation relative to the Earth's gravitational field. In some embodiments, the magnetic toolface sensor 70 detects the current toolface when the end of the wellbore 34 is less than about 7° from vertical, and the gravity toolface sensor 72 detects the current toolface when the end of the wellbore 34 is greater than about 7° from vertical. Other toolface sensors may also be utilized within the scope of the present disclosure that may be more or less precise (or have the same degree of precision), including non-magnetic toolface sensors and non-gravitational inclination sensors. The MWD torque sensor 74 is configured to detect a value or range of values for torque applied to the bit by the motor(s) of the BHA 38. The MWD weight-on-bit ("WOB") sensor 76 is configured to detect a value (or range of values) for WOB at or near the BHA 38.

The following data may be sent to the controller 58 via one or more signals, such as, for example, electronic signal via wired or wireless transmission, mud-pulse telemetry, another signal, or any combination thereof: the casing pressure data detected by the MWD casing pressure sensor 64, the shock/vibration data detected by the MWD shock/vibration sensor 66, the pressure differential data detected by the mud motor ΔP sensor 68, the toolface orientation data detected by the toolface sensors 70 and 72, the torque data detected by the MWD torque sensor 74, and/or the WOB data detected by the MWD WOB sensor 76. The pressure differential data detected by the mud motor ΔP sensor 68 may alternatively (or additionally) be calculated, detected, or otherwise determined at the surface, such as by calculating the difference between the surface standpipe pressure just off-bottom and the pressure measured once the bit touches bottom and starts drilling and experiencing torque.

The BHA 38 may also include a MWD survey tool 78—in some embodiments, the MWD survey tool 78 is, includes, or is part of the MWD survey tool 38*e* shown in FIG. 1. The MWD survey tool 78 may be configured to perform surveys at intervals along the wellbore 34, such as during drilling and tripping operations. The MWD survey tool 78 may include one or more gamma ray sensors that detect gamma data. The data from these surveys may be transmitted by the MWD survey tool 78 to the controller 58 through various telemetry methods, such as mud pulses. In other embodiments, survey data is collected and stored by the MWD survey tool 78 in an associated memory 80. This data may be uploaded to the controller 58 at a later time, such as when the MWD survey tool 78 is removed from the wellbore 34 or during maintenance. Some embodiments use alternative data gathering sensors or obtain information from other sources. For example, the BHA 38 may include sensors for making additional measurements, including, for example and without limitation, azimuthal gamma data, neutron density, porosity, and resistivity of surrounding formations. In some embodiments, such information may be obtained from third parties or may be measured by systems other than the BHA 38.

The BHA 38 may include a memory 80 and a transmitter 82. In some embodiments, the memory 80 and transmitter 82 are integral parts of the MWD survey tool 78, while in other embodiments, the memory 80 and transmitter 82 are separate and distinct modules. The memory 80 may be any type of memory device, such as a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, or other forms of volatile and non-volatile memory. The memory 80 may be configured to store readings and measurements for some period of time. In some embodiments, the memory 80 is configured to store the results of surveys performed by the MWD survey tool 78 for some period of time, such as the time between drilling connections, or until the memory 80 may be downloaded after a tripping out operation. The transmitter 82 may be any type of device to transmit data from the BHA 38 to the controller 58, and may include a mud pulse transmitter. In some embodiments, the MWD survey tool 78 is configured to transmit survey results in real-time to the surface through the transmitter 82. In other embodiments, the MWD survey tool 78 is configured to store survey results in the memory 80 for a period of time, access the survey results from the memory 80, and transmit the results to the controller 58 through the transmitter 82.

The top drive 24 includes one or more sensors (typically a plurality of sensors) located and configured about the top drive 24 to detect parameters relating to the condition and orientation of the drill string 32, and/or other information. For example, the top drive 24 may include a rotary torque sensor 84, a quill position sensor 86, a hook load sensor 88, a pump pressure sensor 90, a mechanical specific energy ("MSE") sensor 92, and a rotary RPM sensor 94—in some embodiments, one or more of these sensors is, includes, or is part of the following sensor shown in FIG. 1: the torque sensor 24*a*, the speed sensor 24*b*, the WOB sensor 24*c*, and/or the casing annular pressure sensor 48. The top drive 24 also includes a controller 96 for controlling the rotational position, speed, and direction of the quill 28 and/or another component of the drill string 32 coupled to the top drive 24—in some embodiments, the controller 96 is, includes, or is part of the controller 58.

The rotary torque sensor 84 is configured to detect a value (or range of values) for the reactive torsion of the quill 28 or the drill string 32. The quill position sensor 86 is configured to detect a value (or range of values) for the rotational position of the quill 28 (e.g., relative to true north or another stationary reference). The hook load sensor 88 is configured to detect the load on the hook 26 as it suspends the top drive 24 and the drill string 32. The pump pressure sensor 90 is configured to detect the pressure of the mud pump(s) 42 providing mud or otherwise powering the BHA 38 from the surface. In some embodiments, rather than being included as part of the top drive 24, the pump pressure sensor 90 may be incorporated into, or included as part of, the mud pump(s) 42. The MSE sensor 92 is configured to detect the MSE representing the amount of energy required per unit volume of drilled rock—in some embodiments, the MSE is not directly detected, but is instead calculated at the controller 58 (or another controller) based on sensed data. The rotary RPM sensor 94 is configured to detect the rotary RPM of the drill string 32—this may be measured at the top drive 24 or elsewhere (e.g., at surface portion of the drill string 32). The following data may be sent to the controller 58 via one or more signals, such as, for example, electronic signal via wired or wireless transmission: the rotary torque data detected by the rotary torque sensor 84, the quill position data detected by the quill position sensor 86, the hook load data detected by the hook load sensor 88, the pump pressure data detected by the pump pressure sensor 90, the MSE data detected (or calculated) by the MSE sensor 92, and/or the RPM data detected by the RPM sensor 88.

The mud pump(s) 42 include a controller 98 and/or other means for controlling the pressure and flow rate of the drilling mud produced by the mud pump(s) 42—such control may include torque and speed control of the mud pump(s) 42 to manipulate the pressure and flow rate of the drilling mud and the ramp-up or ramp-down rates of the mud pump(s) 42. In some embodiments, the controller 98 is, includes, or is part of the controller 58.

The drawworks 22 include a controller 100 and/or other means for controlling feed-out and/or feed-in of the drilling line 20 (shown in FIG. 1)—such control may include rotational control of the drawworks to manipulate the height or position of the hook and the rate at which the hook ascends or descends. The drill string feed-off system of the drawworks 22 may instead be a hydraulic ram or rack and pinion type hoisting system rig, where the movement of the drill string 32 up and down is facilitated by something other than a drawworks. The drill string 32 may also take the form of coiled tubing, in which case the movement of the drill string 32 in and out of the wellbore 34 is controlled by an injector head which grips and pushes/pulls the tubing in/out of the wellbore 34. Such embodiments still include a version of the controller 100 configured to control feed-out and/or feed-in of the drill string 32. In some embodiments, the controller 100 is, includes, or is part of the controller 58.

The controller 58 may be configured to receive data or information relating to one or more of the above-described parameters from the user-interface 56, the BHA 38 (including the MWD survey tool 78), the top drive 24, the mud pump(s) 42, and/or the drawworks 22, as described above, and to utilize such information to enable effective and efficient drilling. In some embodiments, the parameters are transmitted to the controller 58 by one or more data channels. In some embodiments, each data channel may carry data or information relating to a particular sensor. The controller 58 may be further configured to generate a control signal, such as via intelligent adaptive control, and provide the control signal to the top drive 24, the mud pump(s) 42, and/or the drawworks 22 to adjust and/or maintain one or more of the following: the rotational position, speed, and direction of the quill 28 and/or another component of the drill string 32 coupled to the top drive 24, the pressure and flow rate of the drilling mud produced by the mud pump(s) 42, and the feed-out and/or feed-in of the drilling line 20. Moreover, the controller 96 of the top drive 24, the controller 98 of the mud pump(s) 42, and/or the controller 100 of the drawworks 22 may be configured to generate and transmit a signal to the controller 58—these signal(s) influence the control of the top drive 24, the mud pump(s) 42, and/or the drawworks 22. In addition, or instead, any one of the controllers 96, 98, and 100 may be configured to generate and transmit a signal to another one of the controllers 96, 98, or 100, whether directly or via the controller 58—as a result, any combination of the controllers 96, 98, and 100 may be configured to cooperate in controlling the top drive 24, the mud pump(s) 42, and/or the drawworks 22.

In operation, the drilling rig 10 and/or the apparatus 54 are utilized to drill stands down one after the other in order to advance the drill string 32 and the wellbore 34 in accordance with the well plan. To begin the process of drilling down a particular stand, the stand is connected at the top of the drill string 32 on the rig floor 14. Moreover, the top drive 24 is connected to an upper end portion of the made-up stand. The mud pump(s) 42 are started to initiate the flow of drilling mud into the made-up stand and the drill string 32. Before, during, or after the starting of the mud pump(s) 42, the drawworks 22 are used to reel in the drilling line 20 so that the drill string 32 is lifted out of slips—thereafter, the drilling line 20 is reeled out to lower the BHA 38 to the bottom of the wellbore 34. Before, during, or after the lowering of the BHA 38 to the bottom of the wellbore 34, the mud pump(s) 42 are ramped up (e.g., in one or more stages) to circulate drilling mud downhole through the drill string 32 to the BHA 38 and uphole in an annulus between the drill string 32 and the wellbore 34 to the surface. In some embodiments, the drilling mud is instead circulated downhole in the annulus between the drill string 32 and the wellbore 34 to the BHA 38 and uphole through the drill string 32 to the surface. During or after the ramping up of the mud pump(s) 42, drilling is initiated by rotating the top drive 24 (for rotary drilling) and/or rotating the motor(s) 52 of the BHA 38 (for slide drilling) to thereby rotate the drill bit 40.

Surveys are conducted at each drill pipe or stand connection—these periodic surveys are transmitted from the BHA 38 to the surface via the transmitter 82 the MWD survey tool (e.g., 38*e* or 78) so that a geosteerer (or directional driller), may assess whether the BHA 38 (and thus the wellbore 34) is substantially following the well plan (or whether the well plan needs adjustment). If the geosteerer determines that the wellbore 34's trajectory needs to be changed, the recommended change must be effectively communicated to the control system and/or a driller at or near the rig floor 14.

Figure 3:
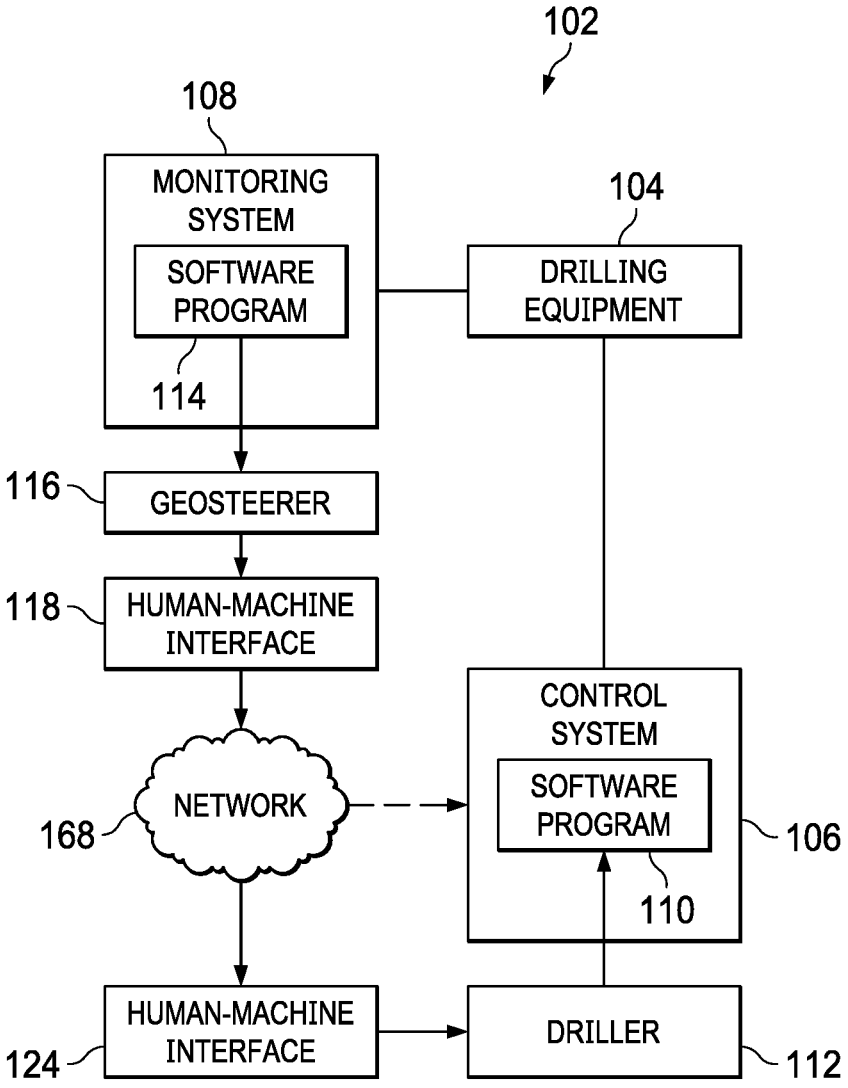
FIG. 3 is a diagrammatic illustration of a system that may be implemented within the environment and/or the drilling rig of FIG. 1, and/or within the environment and/or the apparatus 54 of FIG. 2, the system including first and second human-machine interfaces ("HMI"), drilling equipment, a control system, and a monitoring system, according to one or more embodiments of the present disclosure.

Referring to FIG. 3, effective communication of a desired wellbore 34 trajectory is facilitated by a system generally referred to by the reference numeral 102. The system 102 enables the trajectory of the wellbore 34 to be adjusted periodically to ensure compliance with the well plan. In addition, or instead, the system 102 enables adjustment of the well plan itself in view of differences between measurements of the subsurface lithology (taken prior to the drilling of the wellbore 34) and real-time or delayed time data received from the downhole MWD or wireline conveyed instruments described herein. The system 102 includes drilling equipment 104 for drilling down stands to advance the wellbore 34, a control system 106 connected to the drilling equipment 104 and adapted to control the operation thereof to drill the wellbore 34, and a monitoring system 108 connected to the drilling equipment 104 and adapted to monitor the drilling of the wellbore 34. The control system 106 includes, is associated with, or is adapted to execute, a software program 110 and is operable by a driller 112 to control the drilling equipment 104. The control system 106 may include, for example, the control system 50, the controller 58, the controller 96, the controller 98, the controller 100, another computing device (not shown) or any combination thereof. The drilling equipment 104 may include, for example, the drawworks 22, the top drive 24, the BHA 38, the mud pump(s) 42, another component of the drilling rig 10, the apparatus 54, or the system 102, or any combination thereof. The monitoring system 108 includes, is associated with, or is adapted to execute, a software program 114 that is operable by a geosteerer 116 to determine a desired trajectory of the wellbore 34 relative to the well plan and/or a current trajectory of the wellbore 34. Upon determining the desired trajectory of the wellbore 34, the geosteerer 116 enters the desired trajectory into a human-machine interface ("HMI") 118.

In some embodiments, the monitoring system 108 includes the MWD survey tool 38*e* or 78—the monitoring system 108 may additionally (or alternatively) include, for example, the torque sensor 24*a*, the speed sensor 24*b*, the WOB sensor 24*c*, the downhole annular pressure sensor 38*a*, the shock/vibration sensor 38*b*, the toolface sensor 38*c*, the WOB sensor 38*d*, the surface casing annular pressure sensor 48, mud motor ΔP sensor 52*a*, the torque sensor(s) 52*b*, the MWD casing pressure sensor 64, the MWD shock/vibration sensor 66, the mud motor ΔP sensor 68, the magnetic toolface sensor 70, the gravity toolface sensor 72, the MWD torque sensor 74, the MWD WOB sensor 76, the rotary torque sensor 84, quill position sensor 86, the hook load sensor 88, the pump pressure sensor 90, the MSE sensor 92, the rotary RPM sensor 94, or any combination thereof. In some embodiments, the monitoring system 108 additionally (or alternatively) includes a computing device (not shown) operable by the geosteerer 116 to execute the software program 114. Moreover, although shown as part of the monitoring system 108, in some embodiments, the software program 114 is operable by the geosteerer 116 (after the geosteerer 116 obtains the necessary information from the monitoring system 108) on a separate computing device (not shown) to determine the desired trajectory of the wellbore 34 relative to the well plan and/or the current trajectory of the wellbore 34. Thereafter, the geosteerer enters the desired trajectory into the HMI 118, as will be described in further detail below.

Figure 4:
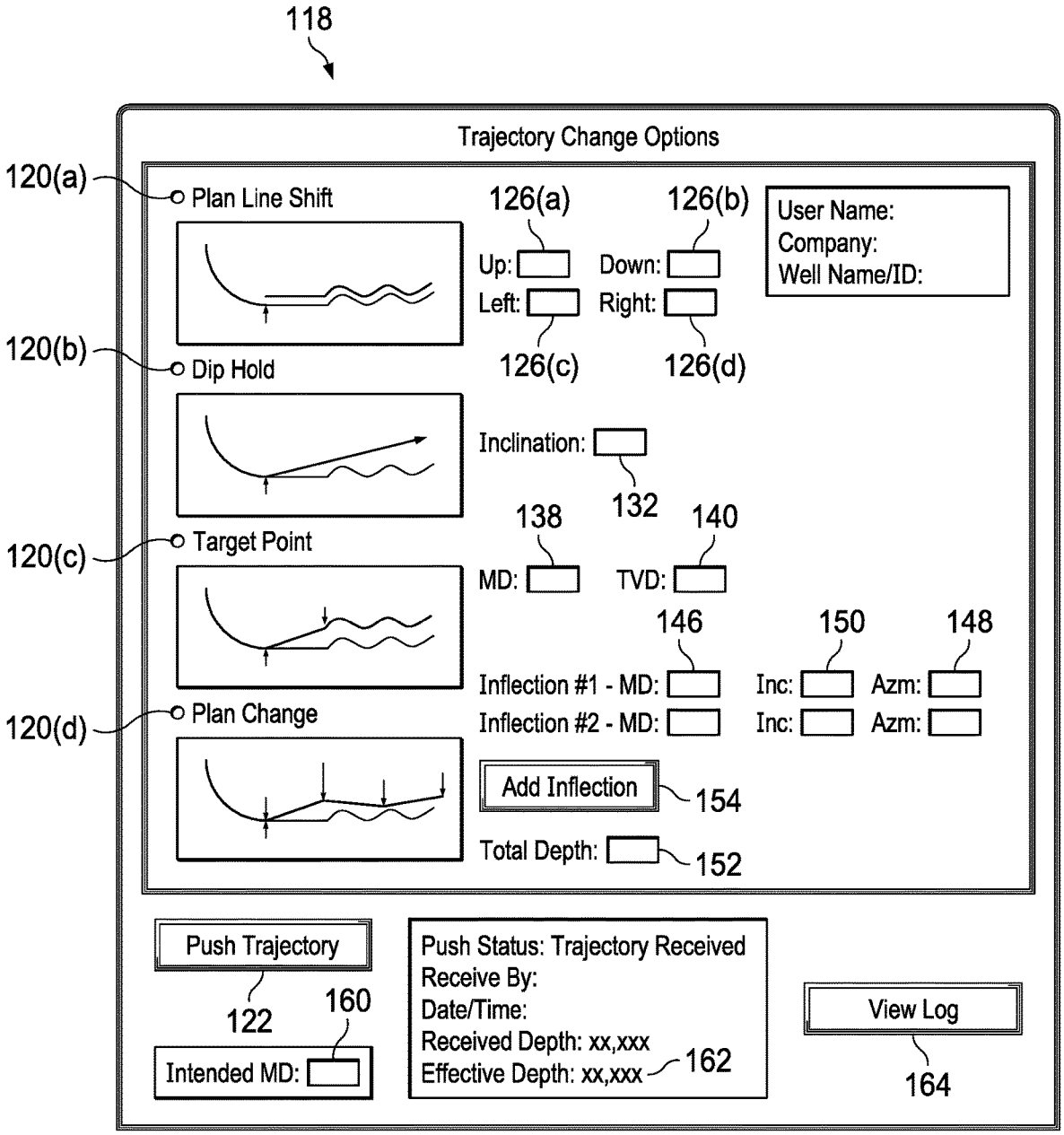
FIG. 4 is a graphical illustration of first, second, third, and fourth selectable trajectory types adapted to be presented on the first HMI of FIG. 3, according to one or more embodiments of the present disclosure.
Figure 5A:
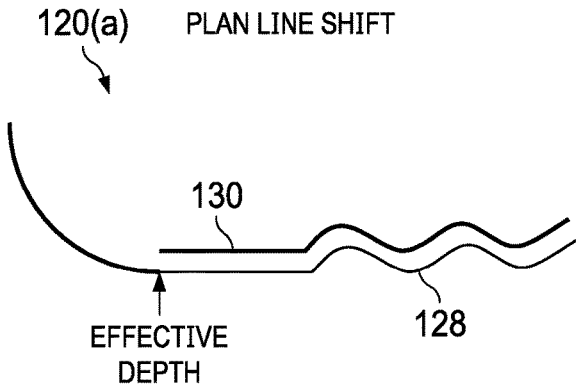
FIG. 5(*a*) is a graphical illustration of at least a portion of the first selectable trajectory type of FIG. 4, according to one or more embodiments of the present disclosure.
Figure 5B:
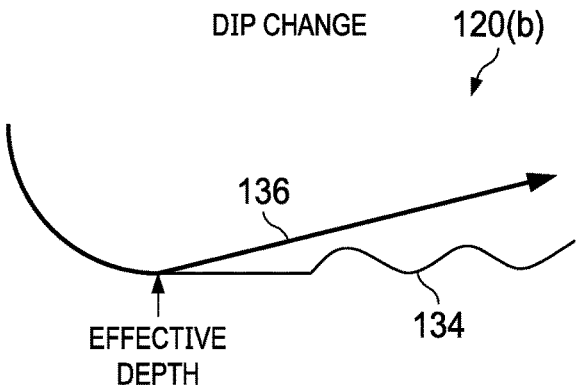
Figure 5C:
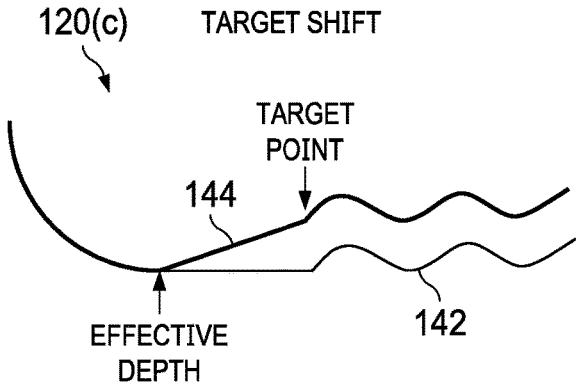
Figure 5D:
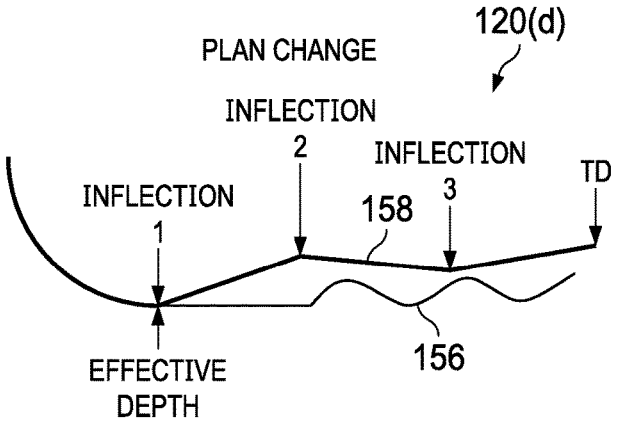

Turning to FIG. 4, in an embodiment, selectable trajectory types 120(*a*)-(*d*) are presented to the geosteerer 116 on the HMI 118, each of the trajectory types 120(*a*)-(*d*) representing a potential trajectory of the wellbore 34 and including one or more data fields into which one or more task parameters needed to drill the wellbore 34 along the desired trajectory are enterable. To initiate the process of adjusting the trajectory of the wellbore 34, the geosteerer 116 selects the trajectory type 120(*a*)-(*d*) most closely representing the desired trajectory of the wellbore 34 and enters the one or more corresponding task parameters into the one or more data fields. The geosteerer 116 then pushes (by selecting a "push trajectory" button 122 on the HMI 118) the selected trajectory type (i.e., 120(*a*), 120(*b*), 120(*c*), or 120(*d*)) and the one or more entered task parameters to one or both of a human-machine interface ("HMI") 124 and the control system 106 (shown in FIG. 3), as will be described in further detail below.

As shown in FIGS. 4 and 5(*a*), the selectable trajectory type 120(*a*) may be referred to as a "plan line shift" trajectory type and represents a potential trajectory in which the wellbore 34 is shifted relative to the well plan and/or the current trajectory of the wellbore 34—the plan line shift trajectory type 120(*a*) includes data fields in which the following task parameters are adapted to be entered by the geosteerer 116: a first distance 126(*a*), a second distance 126(*b*), a third distance 126(*c*), and a fourth distance 126(*d*) by which the trajectory of the wellbore 34 is adapted to be shifted up, down, left, and right, respectively, relative to the well plan and/or the current trajectory of the wellbore 34. In FIG. 5(*a*), the well plan and/or the current trajectory of the wellbore 34 is represented by reference numeral 128, and the potential trajectory in which the wellbore 34 is shifted is represented by reference numeral 130.

Further, as shown in FIGS. 4 and 5(*b*), the selectable trajectory type 120(*b*) may be referred to as a "dip hold" trajectory type and represents a potential trajectory in which the wellbore 34 has a constant inclination—the dip hold trajectory type 120(*b*) includes a data filed in which the following task parameter is adapted to be entered by the geosteerer 116: an inclination 132 of the wellbore 34. In FIG. 5(*b*), the well plan and/or the current trajectory of the wellbore 34 is represented by reference numeral 134, and the potential trajectory in which the wellbore 34 has a constant inclination is represented by reference numeral 136.

Further still, as shown in FIGS. 4 and 5(*c*), the selectable trajectory type 120(*c*) may be referred to as a "target point" trajectory type and represents a potential trajectory in which the wellbore 34 is directed to a target point—the target point trajectory type 120(*c*) includes data fields in which the following task parameters are adapted to be entered by the geosteerer 116: an estimate 138 of the measured depth of the wellbore 34 at the target point, and an estimate 140 of the true vertical depth of the wellbore 34 at the target point. In FIG. 5(*c*), the well plan and/or the current trajectory of the wellbore 34 is represented by reference numeral 142, and the potential trajectory in which the wellbore 34 is directed to the target point is represented by reference numeral 144.

Finally, as shown in FIGS. 4 and 5(*d*), the selectable trajectory type 120(*d*) may be referred to as a "plan change" trajectory type and represents a potential trajectory in which the wellbore 34 includes one or more inflection points that are each followed by a corresponding wellbore 34 segment with constant azimuth and inclination—the plan change trajectory type 120(*d*) includes data fields in which the following task parameters are adapted to be entered by the geosteerer 116: a measured depth 146 for each of the one or more inflection points, azimuth 148 and inclination 150 values for the one or more corresponding wellbore 34 segments, and a total depth 152 of the wellbore 34 at which the plan change is meant to terminate. Moreover, the plan change trajectory type 120(*d*) includes an "add inflection" button 154 that, when selected, adds an inflection point and a corresponding wellbore 34 segment with constant azimuth and inclination to the plan change trajectory type 120(*d*)—as a result, the geosteerer 116 can enter any desired number of inflection points into the plan change trajectory type 120(*d*). In FIG. 5(*c*), the well plan and/or the current trajectory of the wellbore 34 is represented by reference numeral 156, and the potential trajectory in which the wellbore 34 includes one or more inflection points followed by corresponding wellbore 34 segments with constant azimuth and inclination is represented by reference numeral 158.

Figures 6, 7A:
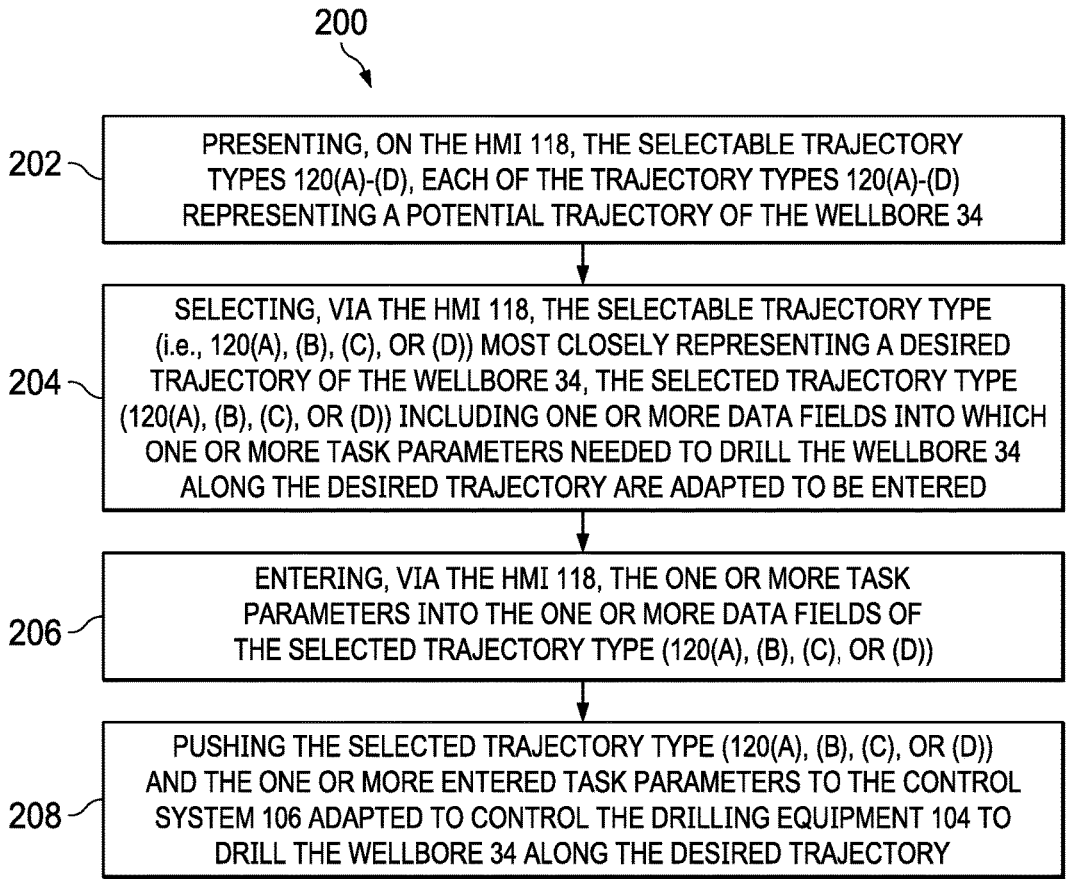
FIG. 6 is a graphical illustration of a trajectory log adapted to be presented on the first HMI of FIG. 4, according to one or more embodiments of the present disclosure.
Figure 7B:
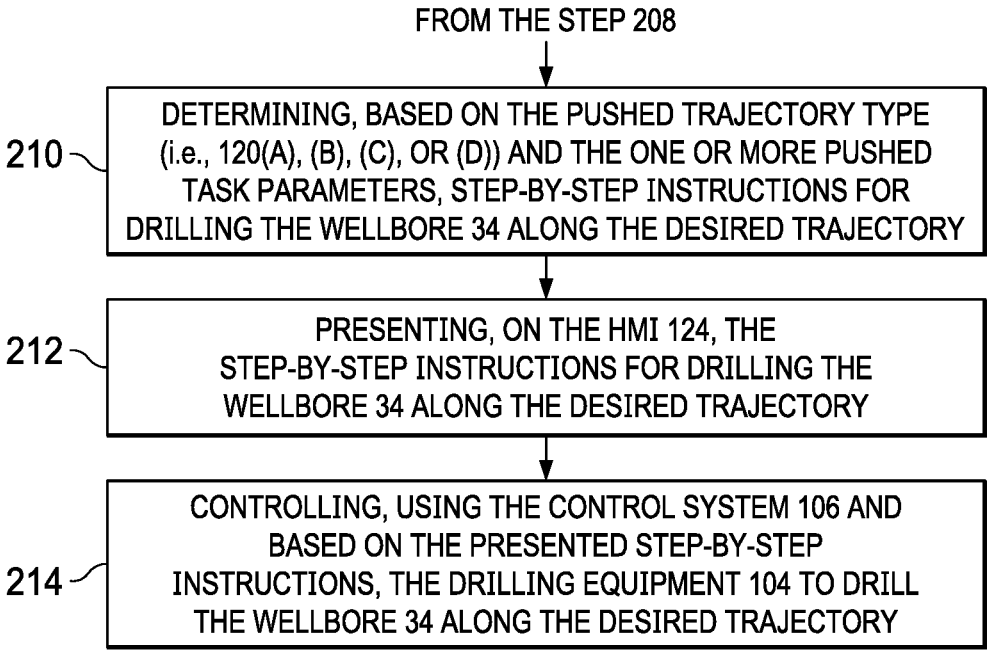
FIG. 7(*a*) is a flow diagram of a method for implementing one or more embodiments of the present disclosure.
Figure 7C:
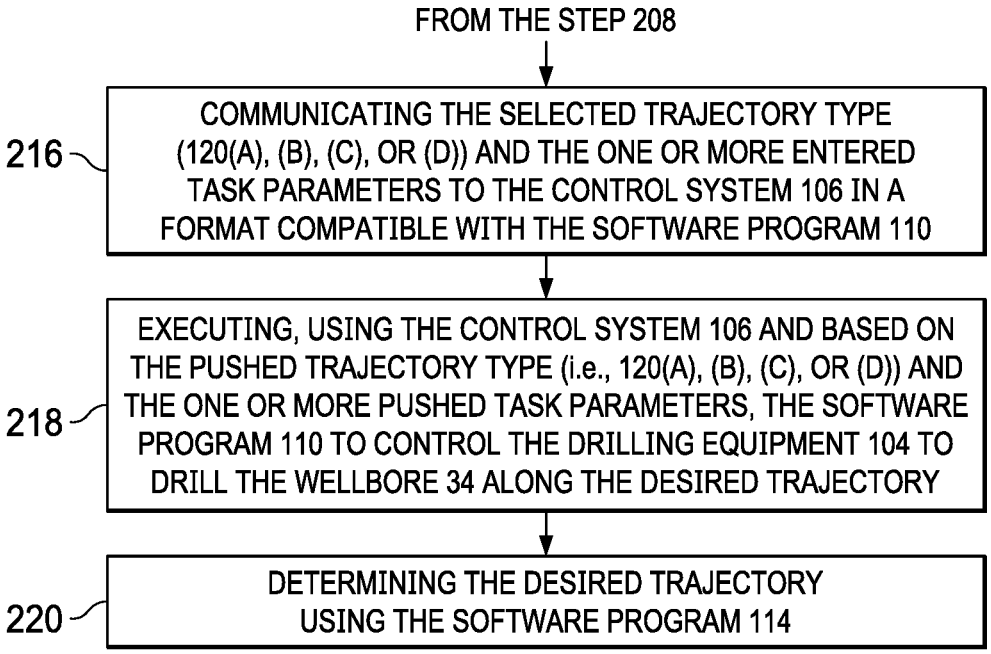
Figure 7D:
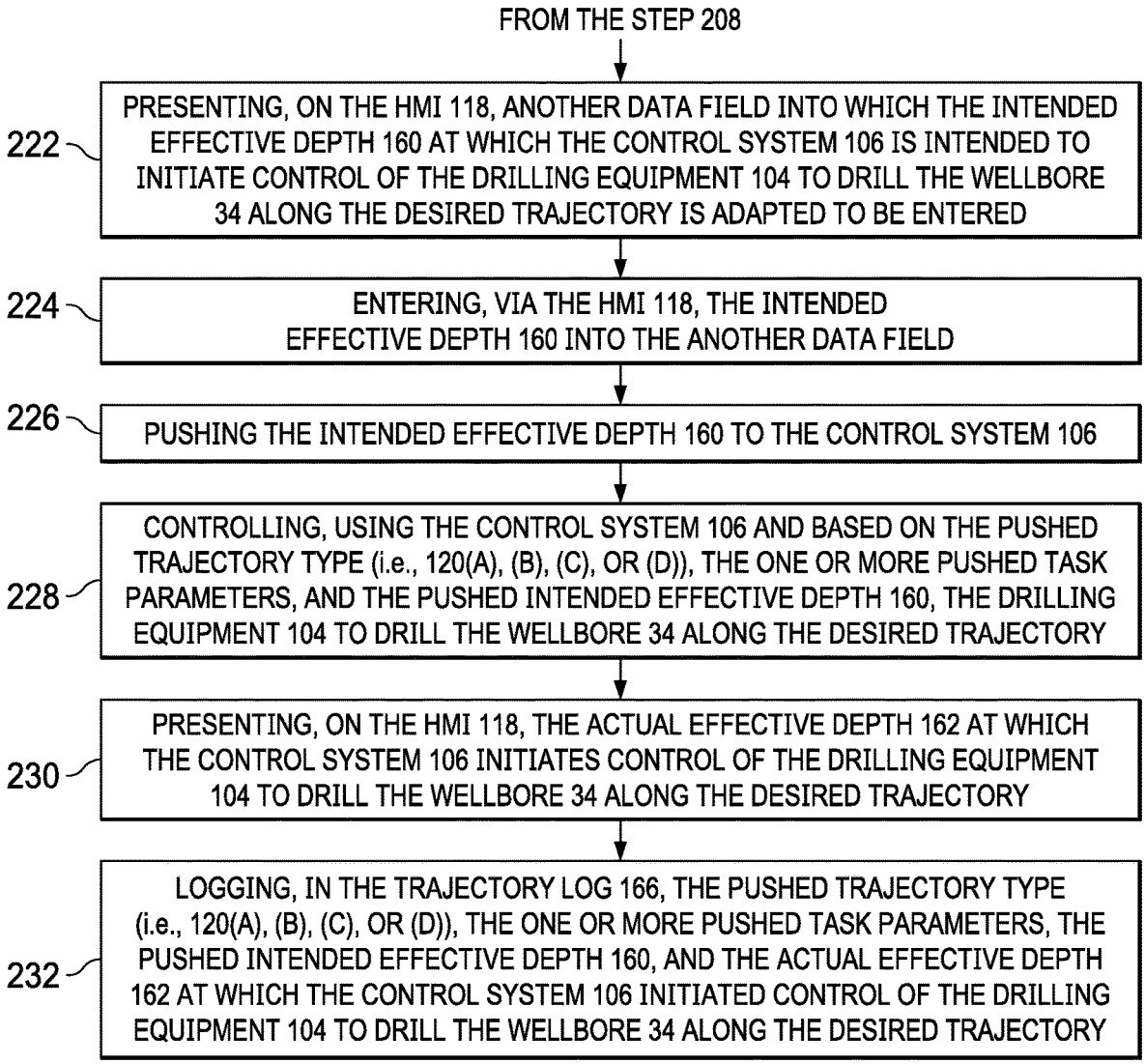

Referring still to FIG. 4, in an embodiment, another data field is presented on the HMI 118, where a user may enter an intended effective depth 160 at which the control system 106 is intended to initiate control of the drilling equipment 104 to drill the wellbore 34 along the desired trajectory. In some embodiments, the intended effective depth is pushed to the control system 106 along with the selected trajectory type (i.e., 120(*a*), (*b*), (*c*), or (*d*)) and the one or more entered task parameters. The control system 106 is thus capable of controlling the drilling equipment 104, based on the pushed trajectory type (i.e., 120(*a*), (*b*), (*c*), or (*d*)), the one or more pushed task parameters, and the pushed intended effective depth 160, to drill the wellbore 34 along the desired trajectory. In some embodiments, an actual effective depth 162 is presented on the HMI 118, at which actual effective depth 162 the control system 106 initiates control of the drilling equipment 104 to drill the wellbore 34 along the desired trajectory. In addition, the geosteerer 116 may select a "view log" button 164 presented on the HMI 118 to view a trajectory log 166 (shown in FIG. 6) in which at least the pushed trajectory type (i.e., 120(*a*), (*b*), (*c*), or (*d*)), the one or more pushed task parameters, the pushed intended effective depth 160, and the actual effective depth 162 at which the control system 106 initiates control of the drilling equipment 104 to drill the wellbore 34 along the desired trajectory are stored.

Turning again to FIG. 3, the geosteerer 116 pushes (by selecting the "push trajectory" button 122 on the HMI 118) the selected trajectory type (120(*a*), 120(*b*), 120(*c*), or 120(*c*)) and the one or more entered task parameters to one or both of the HMI 124 and the control system 106. More particularly, the geosteerer 116 pushes the selected trajectory type (120(*a*), 120(*b*), 120(*c*), or 120(*c*)) and the one or more entered task parameters to a network 168 that is communicatively connected to the HMI 124 and/or the control system 106. The selected trajectory type (120(*a*), 120(*b*), 120(*c*), or 120(*c*)) and the one or more entered task parameters are then communicated from the network 168 to the HMI 124. In some embodiments, the HMI 124 is located at or near the drilling equipment 104 and the HMI 118 is located remote from the drilling equipment 104. In some embodiments, step-by-step instructions for drilling the wellbore 34 along the desired trajectory are presented on the HMI 124 so as to be ascertainable by the driller 112 (e.g., visually, audibly, etc.) at or near the rig floor 14. The step-by-step instructions are determined based on the selected trajectory type (120(*a*), 120(*b*), 120(*c*), or 120(*c*)) and/or the one or more task parameters.

Upon receipt, the driller 112 is able to operate the control system 106 in accordance with the step-by-step instructions to drill the wellbore 34 along the desired trajectory. More particularly, the control system 106 includes, is associated with, or is adapted to execute, the software program 110, which software program is operable by the driller 112 to control the drilling equipment 104. In some embodiments, the software program 110 is different from the software program 114. In addition, or instead, the selected trajectory type (120(*a*), 120(*b*), 120(*c*), or 120(*c*)) and the one or more entered task parameters may be communicated from the network 168 to the control system 106 (as indicated by the dashed-line arrow in FIG. 3). In some embodiments, the control system 106 additionally (or alternatively) includes a computing device (not shown) operable by the driller 112 to execute the software program 110. Moreover, although shown as part of the control system 106, in some embodiments, the software program 110 is operable by the driller 112 (upon receipt of the necessary step-by-step instructions from the HMI 124) on a separate computing device (not shown) to control the drilling equipment 104 to drill the wellbore 34 along the desired trajectory.

Referring to FIG. 7(*a*), a method is diagrammatically illustrated and generally referred to by the reference numeral 200—in relation to the method 200, the term "drilling equipment" may refer to any combination of the drawworks 22, the top drive 24, the BHA 38, the mud pump(s) 42, the control system 50, and one or more other components of the drilling rig 10, the apparatus 54, or the system 102. In some embodiments, the method 200 includes presenting, on the HMI 118, the selectable trajectory types 120(*a*)-(*d*), each of the trajectory types 120(*a*)-(*d*) representing a potential trajectory of the wellbore 34 at a step 202; selecting, via the HMI 118, the selectable trajectory type (i.e., 120(*a*), (*b*), (*c*), or (*d*)) most closely representing a desired trajectory of the wellbore 34, the selected trajectory type (120(*a*), (*b*), (*c*), or (*d*)) including one or more data fields into which one or more task parameters needed to drill the wellbore 34 along the desired trajectory are adapted to be entered at a step 204; entering, via the HMI 118, the one or more task parameters into the one or more data fields of the selected trajectory type (120(*a*), (*b*), (*c*), or (*d*)) at a step 206; and pushing the selected trajectory type (120(*a*), (*b*), (*c*), or (*d*)) and the one or more entered task parameters to the control system 106 adapted to control the drilling equipment 104 to drill the wellbore 34 along the desired trajectory at a step 208.

In some embodiments of the method 200, the potential trajectory of the wellbore 34 represented by the selected trajectory type (120(*a*), (*b*), (*c*), or (*d*)) is shifted relative to a current trajectory of the wellbore 34, and the one or more task parameters needed to drill the wellbore 34 along the desired trajectory include first, second, third, and fourth distances by which the trajectory of the wellbore 34 is shifted up, down, left, and right, respectively, relative to the current trajectory. In some embodiments of the method 200, the potential trajectory of the wellbore 34 represented by the selected trajectory type (120(*a*), (*b*), (*c*), or (*d*)) has a constant inclination, and the one or more task parameters needed to drill the wellbore 34 along the desired trajectory include an inclination of the wellbore 34. In some embodiments of the method 200, the potential trajectory of the wellbore 34 represented by the selected trajectory type (120(*a*), (*b*), (*c*), or (*d*)) is directed to a target point, and the one or more task parameters needed to drill the wellbore 34 along the desired trajectory include estimates of a measured depth and a true vertical depth of the wellbore 34 at the target point. In some embodiments of the method 200, the potential trajectory of the wellbore 34 represented by the selected trajectory type (120(*a*), (*b*), (*c*), or (*d*)) includes one or more inflection points that are each followed by a corresponding wellbore 34 segment with constant azimuth and inclination, and the one or more task parameters needed to drill the wellbore 34 along the desired trajectory include a measured depth for each of the one or more inflection points, and azimuth and inclination values for the one or more corresponding wellbore 34 segments.

Further, turning to FIG. 7(*b*), in an embodiment, the method 200 further includes one or more of the following steps: determining, based on the pushed trajectory type (i.e., 120(*a*), (*b*), (*c*), or (*d*)) and the one or more pushed task parameters, step-by-step instructions for drilling the wellbore 34 along the desired trajectory at a step 210; presenting, on the HMI 124, the step-by-step instructions for drilling the wellbore 34 along the desired trajectory at a step 212; and controlling, using the control system 106 and based on the presented step-by-step instructions, the drilling equipment 104 to drill the wellbore 34 along the desired trajectory at a step 214. In some embodiments of the method 200, the HMI 124 is located at or near the drilling equipment 104 and the wellbore 34, and the HMI 118 is located remotely from the drilling equipment 104 and the wellbore 34.

Further still, turning to FIG. 7(*c*), in an embodiment, the method 200 further includes one or more of the following steps: communicating the selected trajectory type (120(*a*), (*b*), (*c*), or (*d*)) and the one or more entered task parameters to the control system 106 in a format compatible with the software program 110 at a step 216; executing, using the control system 106 and based on the pushed trajectory type (i.e., 120(*a*), (*b*), (*c*), or (*d*)) and the one or more pushed task parameters, the software program 110 to control the drilling equipment 104 to drill the wellbore 34 along the desired trajectory at a step 218; and determining the desired trajectory using the software program 114 at a step 220.

Finally, turning to FIG. 7(*d*), in an embodiment, the method 200 further includes one or more of the following steps: presenting, on the HMI 118, another data field into which the intended effective depth 160 at which the control system 106 is intended to initiate control of the drilling equipment 104 to drill the wellbore 34 along the desired trajectory is adapted to be entered at a step 222; entering, via the HMI 118, the intended effective depth 160 into the another data field at a step 224; pushing the intended effective depth 160 to the control system 106 at a step 226; controlling, using the control system 106 and based on the pushed trajectory type (i.e., 120 (*a*), (*b*), (*c*), or (*d*)), the one or more pushed task parameters, and the pushed intended effective depth 160, the drilling equipment 104 to drill the wellbore 34 along the desired trajectory at a step 228; presenting, on the HMI 118, the actual effective depth 162 at which the control system 106 initiates control of the drilling equipment 104 to drill the wellbore 34 along the desired trajectory at a step 230; and logging, in the trajectory log 166, the pushed trajectory type (i.e., 120 (*a*), (*b*), (*c*), or (*d*)), the one or more pushed task parameters, the pushed intended effective depth 160, and the actual effective depth 162 at which the control system 106 initiates control of the drilling equipment 104 to drill the wellbore 34 along the desired trajectory at a step 232.

Figure 8:
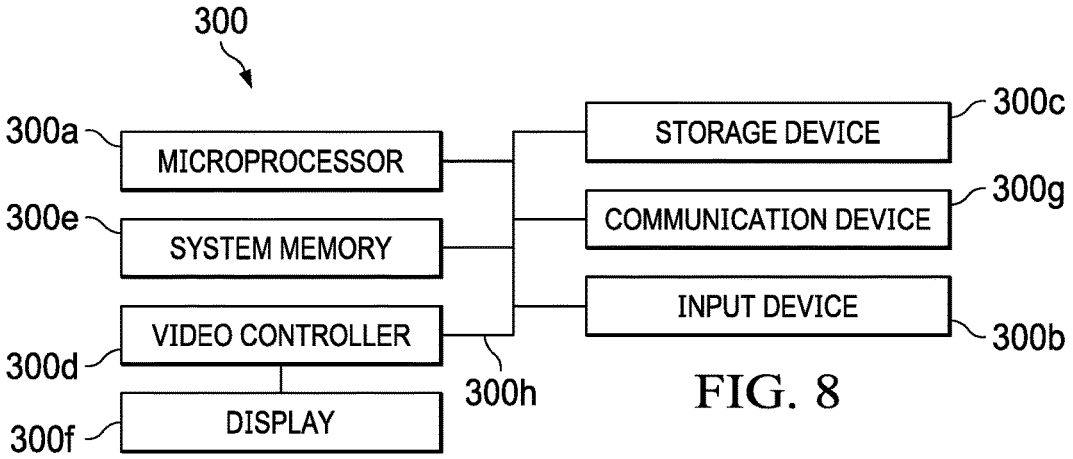
FIG. 8 is a diagrammatic illustration of a computing device for implementing one or more embodiments of the present disclosure.

Referring to FIG. 8, an embodiment of a computing device 300 for implementing one or more embodiments of one or more of the above-described controllers (e.g., 58, 96, 98, or 100), control systems (e.g., 50 or 106), monitoring systems (e.g., 108), software programs (e.g., 110, or 114), human-machine interfaces (e.g., HMI 118 or 124), methods (e.g., 200), and/or steps (e.g., 202, 204, 206, 208, 210, 212, 214, 216, 218, 220, 222, 224, 226, 228, 230, or 232), and/or any combination thereof, is depicted. The computing device 300 includes a microprocessor 300*a*, an input device 300*b*, a storage device 300*c*, a video controller 300*d*, a system memory 300*e*, a display 300*f*, and a communication device 300*g* all interconnected by one or more buses 300*h*. In some embodiments, the storage device 300*c* may include a floppy drive, hard drive, CD-ROM, optical drive, any other form of storage device and/or any combination thereof. In some embodiments, the storage device 300*c* may include, and/or be capable of receiving, a floppy disk, CD-ROM, DVD-ROM, or any other form of computer-readable medium that may contain executable instructions. In some embodiments, the communication device 300*g* may include a modem, network card, or any other device to enable the computing device to communicate with other computing devices. In some embodiments, any computing device represents a plurality of interconnected (whether by intranet or Internet) computer systems, including without limitation, personal computers, mainframes, PDAs, smartphones and cell phones.

The computing device can send a network message using proprietary protocol instructions to render 3D models and/or medical data. The link between the computing device and the display unit and the synchronization between the programmed state of physical manikin and the rendering data/3D model on the display unit of the present invention facilitate enhanced learning experiences for users. In this regard, multiple display units can be used simultaneously by multiple users to show the same 3D models/data from different points of view of the same manikin(s) to facilitate uniform teaching and learning, including team training aspects.

In some embodiments, one or more of the components of the above-described embodiments include at least the computing device 300 and/or components thereof, and/or one or more computing devices that are substantially similar to the computing device 300 and/or components thereof. In some embodiments, one or more of the above-described components of the computing device 300 include respective pluralities of same components.

In some embodiments, a computer system typically includes at least hardware capable of executing machine readable instructions, as well as the software for executing acts (typically machine-readable instructions) that produce a desired result. In some embodiments, a computer system may include hybrids of hardware and software, as well as computer sub-systems.

In some embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In some embodiments, hardware may include any physical device that is capable of storing machine-readable instructions, such as memory or other data storage devices. In some embodiments, other forms of hardware include hardware sub-systems, including transfer devices such as modems, modem cards, ports, and port cards, for example.

In some embodiments, software includes any machine code stored in any memory medium, such as RAM or ROM, and machine code stored on other devices (such as floppy disks, flash memory, or a CD ROM, for example). In some embodiments, software may include source or object code. In some embodiments, software encompasses any set of instructions capable of being executed on a computing device such as, for example, on a client machine or server.

In some embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In some embodiments, computer readable mediums include, for example, passive data storage, such as a random access memory (RAM) as well as semi-permanent data storage such as a compact disk read only memory (CD-ROM). One or more embodiments of the present disclosure may be embodied in the RAM of a computer to transform a standard computer into a new specific computing machine. In some embodiments, data structures are defined organizations of data that may enable an embodiment of the present disclosure. In an embodiment, a data structure may provide an organization of data, or an organization of executable code.

In some embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In some embodiments, a database may be any standard or proprietary database software. In some embodiments, the database may have fields, records, data, and other database elements that may be associated through database specific software. In some embodiments, data may be mapped. In some embodiments, mapping is the process of associating one data entry with another data entry. In an embodiment, the data contained in the location of a character file can be mapped to a field in a second table. In some embodiments, the physical location of the database is not limiting, and the database may be distributed. In an embodiment, the database may exist remotely from the server, and run on a separate platform. In an embodiment, the database may be accessible across the Internet. In some embodiments, more than one database may be implemented.

In some embodiments, a plurality of instructions stored on a non-transitory computer readable medium may be executed by one or more processors to cause the one or more processors to carry out or implement in whole or in part the above-described operation of each of the above-described embodiments of the drilling rig 10, the apparatus 54, the system 102, and/or any combination thereof. In some embodiments, such a processor may include the microprocessor 300*a*, and such a non-transitory computer readable medium may include the storage device 300*c*, the system memory 300*e*, or a combination thereof. Moreover, the computer readable medium may be distributed among one or more components of the drilling rig 10, the apparatus 54, and/or the system 102, and/or any combination thereof. In some embodiments, such a processor may execute the plurality of instructions in connection with a virtual computer system. In some embodiments, such a plurality of instructions may communicate directly with the one or more processors, and/or may interact with one or more operating systems, middleware, firmware, other applications, and/or any combination thereof, to cause the one or more processors to execute the instructions.

The present disclosure introduces a system including a first human-machine interface on which a plurality of trajectory types are presented, each of the trajectory types representing a potential trajectory of a wellbore, the trajectory type most closely representing a desired trajectory of the wellbore being selectable via the first human-machine interface, wherein, once so selected, one or more task parameters needed to drill the wellbore along the desired trajectory are enterable into one or more data fields associated with the selected trajectory type; and a control system adapted to control drilling equipment to drill the wellbore along the desired trajectory, wherein, once entered into the one or more data fields, the one or more task parameters are pushable to the control system. In some embodiments, the system further includes a second human-machine interface connected to the control system and on which step-by-step instructions for drilling the wellbore along the desired trajectory are presented, the step-by-step instructions being determined based on the one or more task parameters once the one or more task parameters are pushed to the control system; wherein the second human-machine interface is different from the first human machine interface; and wherein the control system is operable by a user, based on the presented step-by-step instructions, to control the drilling equipment to drill the wellbore along the desired trajectory. In some embodiments, the second human-machine interface is located at or near the drilling equipment and the wellbore, and the first human-machine interface is located remotely from the drilling equipment and the wellbore. In some embodiments, an intended effective depth, at which the control system is intended to initiate control of the drilling equipment to drill the wellbore along the desired trajectory, is enterable into another data field presented on the first human-machine interface; and, once entered into the another data field, the intended effective depth is pushable to the control system. In some embodiments, the system further includes a second human-machine interface connected to the control system and on which step-by-step instructions for drilling the wellbore along the desired trajectory are presented, the step-by-step instructions being determined based on the one or more task parameters and the intended effective depth once the one or more task parameters and the intended effective depth are pushed to the control system; wherein the second human-machine interface is different from the first human machine interface; and wherein the control system is operable by a user, based on the presented step-by-step instructions, to control the drilling equipment to drill the wellbore along the desired trajectory. In some embodiments, once the one or more task parameters and the intended effective depth are pushed to the control system, the one or more task parameters, the intended effective depth, and an actual effective depth at which the control system initiates control of the drilling equipment to drill the wellbore along the desired trajectory are loggable into a trajectory log.

The present disclosure also introduces a method including presenting, on a first human-machine interface, a plurality of selectable trajectory types, each of the trajectory types representing a potential trajectory of a wellbore; receiving a selection, via the first human-machine interface, of a selectable trajectory type of the plurality of selectable trajectory types that most closely represents a desired trajectory of the wellbore, the selected trajectory type including one or more data fields into which one or more task parameters needed to drill the wellbore along the desired trajectory are adapted to be entered; receiving an input, via the first human-machine interface, of the one or more task parameters into the one or more data fields of the selected trajectory type; and pushing the selected trajectory type and the one or more input task parameters to a control system adapted to control drilling equipment to drill the wellbore along the desired trajectory. In some embodiments, the method further includes determining, based on the pushed trajectory type and the one or more pushed task parameters, step-by-step instructions for drilling the wellbore along the desired trajectory; and presenting, on a second human-machine interface, the step-by-step instructions for drilling the wellbore along the desired trajectory, wherein the second human-machine interface is different from the first human-machine interface. In some embodiments, the second human-machine interface is located at or near the drilling equipment and the wellbore, and wherein the first human-machine interface is located remotely from the drilling equipment and the wellbore. In some embodiments, the method further includes controlling, using the control system and based on the presented step-by-step instructions, the drilling equipment to drill the wellbore along the desired trajectory. In some embodiments, pushing the selected trajectory type and the one or more input task parameters to the control system includes communicating the selected trajectory type and the one or more input task parameters to the control system in a format compatible with a first software program; and the method further includes executing, using the control system and based on the pushed trajectory type and the one or more pushed task parameters, the first software program to control the drilling equipment to drill the wellbore along the desired trajectory. In some embodiments, the method further includes determining the desired trajectory using a second software program that is different from the first software program. In some embodiments, the method further includes presenting, on the first human-machine interface, another data field into which an intended effective depth at which the control system is intended to initiate control of the drilling equipment to drill the wellbore along the desired trajectory is adapted to be entered; entering, via the first human-machine interface, the intended effective depth into the another data field; and pushing the intended effective depth to the control system. In some embodiments, the method further includes controlling, using the control system and based on the pushed trajectory type, the one or more pushed task parameters, and the pushed intended effective depth, the drilling equipment to drill the wellbore along the desired trajectory. In some embodiments, the method further includes presenting, on the first human machine interface, an actual effective depth at which the control system initiates control of the drilling equipment to drill the wellbore along the desired trajectory. In some embodiments, the method further includes logging, in a trajectory log, the pushed trajectory type, the one or more pushed task parameters, the pushed intended effective depth, and an actual effective depth at which the control system initiates control of the drilling equipment to drill the wellbore along the desired trajectory. In some embodiments, the potential trajectory of the wellbore represented by the selected trajectory type is shifted relative to a current trajectory of the wellbore, and the one or more task parameters needed to drill the wellbore along the desired trajectory include first, second, third, and fourth distances by which the trajectory of the wellbore is shifted up, down, left, and right, respectively, relative to the current trajectory; the potential trajectory of the wellbore represented by the selected trajectory type has a constant inclination, and the one or more task parameters needed to drill the wellbore along the desired trajectory include an inclination of the wellbore; the potential trajectory of the wellbore represented by the selected trajectory type is directed to a target point, and the one or more task parameters needed to drill the wellbore along the desired trajectory include estimates of a measured depth and a true vertical depth of the wellbore at the target point; or the potential trajectory of the wellbore represented by the selected trajectory type includes one or more inflection points that are each followed by a corresponding wellbore segment with constant azimuth and inclination, and the one or more task parameters needed to drill the wellbore along the desired trajectory include a measured depth for each of the one or more inflection points, and azimuth and inclination values for the one or more corresponding wellbore segments.

The present disclosure also introduces a method including presenting, on a first human-machine interface, a plurality of selectable trajectory types, each of the trajectory types representing a potential trajectory of a wellbore; receiving a selection, via the first human-machine interface, of a selectable trajectory type of the plurality of selectable trajectory types that most closely represents a desired trajectory of the wellbore; pushing the selected trajectory type to a control system adapted to control drilling equipment to drill the wellbore along the desired trajectory; and based on the pushed selected trajectory type, modifying the input of at least one of a top drive, a bottom hole assembly (BHA), a drawworks, and a mud pump to change the trajectory of the wellbore from a current trajectory to the desired trajectory. In some embodiments, the method further includes tracking the pushed selected trajectory type and outputting a table identifying parameters of a drilled wellbore at the time of modifying the input of at least one of the top drive, the bottom hole assembly (BHA), the drawworks, and the mud pump. In some embodiments, the method further includes receiving an input, via the first human-machine interface, of one or more task parameters into one or more data fields of a task parameter needed to drill the wellbore along the desired trajectory, the input including at least one of: a shift distance, an inclination, a depth, and inflection data.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method, comprising:

presenting, on a first human-machine interface, a plurality of selectable trajectory types, each of the trajectory types representing a potential trajectory of a wellbore;

receiving a selection, via the first human-machine interface, of a selectable trajectory type of the plurality of selectable trajectory types that most closely represents a desired trajectory of the wellbore, the selected trajectory type including one or more data fields into which one or more task parameters needed to drill the wellbore along the desired trajectory are adapted to be entered;

receiving an input, via the first human-machine interface, of the one or more task parameters into the one or more data fields of the selected trajectory type; and pushing the selected trajectory type and the one or more input task parameters to a control system adapted to control drilling equipment to drill the wellbore along the desired trajectory.

2. The method of claim 1, further comprising:

determining, based on the pushed trajectory type and the one or more pushed task parameters, step-by-step instructions for drilling the wellbore along the desired trajectory; and presenting, on a second human-machine interface, the step-by-step instructions for drilling the wellbore along the desired trajectory, wherein the second human-machine interface is different from the first human-machine interface.

3. The method of claim 2, wherein the second human-machine interface is located at or near the drilling equipment and the wellbore; and wherein the first human-machine interface is located remotely from the drilling equipment and the wellbore.

4. The method of claim 2, further comprising:

controlling, using the control system and based on the presented step-by-step instructions, the drilling equipment to drill the wellbore along the desired trajectory.

5. The method of claim 1, wherein pushing the selected trajectory type and the one or more input task parameters to the control system comprises communicating the selected trajectory type and the one or more input task parameters to the control system in a format compatible with a first software program; and wherein the method further comprises executing, using the control system and based on the pushed trajectory type and the one or more pushed task parameters, the first software program to control the drilling equipment to drill the wellbore along the desired trajectory.

6. The method of claim 5, further comprising determining the desired trajectory using a second software program that is different from the first software program.

7. The method of claim 1, further comprising:

presenting, on the first human-machine interface, another data field into which an intended effective depth at which the control system is intended to initiate control of the drilling equipment to drill the wellbore along the desired trajectory is adapted to be entered;

entering, via the first human-machine interface, the intended effective depth into the another data field; and pushing the intended effective depth to the control system.

8. The method of claim 7, further comprising:

controlling, using the control system and based on the pushed trajectory type, the one or more pushed task parameters, and the pushed intended effective depth, the drilling equipment to drill the wellbore along the desired trajectory.

9. The method of claim 8, further comprising presenting, on the first human machine interface, an actual effective depth at which the control system initiates control of the drilling equipment to drill the wellbore along the desired trajectory.

10. The method of claim 8, further comprising logging, in a trajectory log, the pushed trajectory type, the one or more pushed task parameters, the pushed intended effective depth, and an actual effective depth at which the control system initiates control of the drilling equipment to drill the wellbore along the desired trajectory.

11. The method of claim 1, wherein:

the potential trajectory of the wellbore represented by the selected trajectory type is shifted relative to a current trajectory of the wellbore, and the one or more task parameters needed to drill the wellbore along the desired trajectory include first, second, third, and fourth distances by which the trajectory of the wellbore is shifted up, down, left, and right, respectively, relative to the current trajectory;

the potential trajectory of the wellbore represented by the selected trajectory type has a constant inclination, and the one or more task parameters needed to drill the wellbore along the desired trajectory include an inclination of the wellbore;

the potential trajectory of the wellbore represented by the selected trajectory type is directed to a target point, and the one or more task parameters needed to drill the wellbore along the desired trajectory include estimates of a measured depth and a true vertical depth of the wellbore at the target point; or the potential trajectory of the wellbore represented by the selected trajectory type includes one or more inflection points that are each followed by a corresponding wellbore segment with constant azimuth and inclination, and the one or more task parameters needed to drill the wellbore along the desired trajectory include a measured depth for each of the one or more inflection points, and azimuth and inclination values for the one or more corresponding wellbore segments.

12. A system, comprising:

a first human-machine interface on which a plurality of trajectory types are presented, each of the trajectory types representing a potential trajectory of a wellbore, the trajectory type most closely representing a desired trajectory of the wellbore being selectable via the first human-machine interface, wherein, once so selected, one or more task parameters needed to drill the wellbore along the desired trajectory are enterable into one or more data fields associated with the selected trajectory type;

a control system adapted to control drilling equipment to drill the wellbore along the desired trajectory, wherein, once entered into the one or more data fields, the one or more task parameters are pushable to the control system; and a second human-machine interface connected to the control system and on which step-by-step instructions for drilling the wellbore along the desired trajectory are presented, the step-by-step instructions being determined based on the one or more task parameters once the one or more task parameters are pushed to the control system;

wherein the second human-machine interface is different from the first human machine interface; and wherein the control system is operable by a user, based on the presented step-by-step instructions, to control the drilling equipment to drill the wellbore along the desired trajectory.

13. The system of claim 12, wherein the second human-machine interface is located at or near the drilling equipment and the wellbore; and wherein the first human-machine interface is located remotely from the drilling equipment and the wellbore.

14. A system, comprising:

a first human-machine interface on which a plurality of trajectory types are presented, each of the trajectory types representing a potential trajectory of a wellbore, the trajectory type most closely representing a desired trajectory of the wellbore being selectable via the first human-machine interface, wherein, once so selected, one or more task parameters needed to drill the wellbore along the desired trajectory are enterable into one or more data fields associated with the selected trajectory type; and a control system adapted to control drilling equipment to drill the wellbore along the desired trajectory, wherein, once entered into the one or more data fields, the one or more task parameters are pushable to the control system;

wherein an intended effective depth, at which the control system is intended to initiate control of the drilling equipment to drill the wellbore along the desired trajectory, is enterable into another data field presented on the first human-machine interface; and wherein, once entered into the another data field, the intended effective depth is pushable to the control system.

15. The system of claim 14, further comprising:

a second human-machine interface connected to the control system and on which step-by-step instructions for drilling the wellbore along the desired trajectory are presented, the step-by-step instructions being determined based on the one or more task parameters and the intended effective depth once the one or more task parameters and the intended effective depth are pushed to the control system;

wherein the second human-machine interface is different from the first human machine interface; and wherein the control system is operable by a user, based on the presented step-by-step instructions, to control the drilling equipment to drill the wellbore along the desired trajectory.

16. The system of claim 15, wherein, once the one or more task parameters and the intended effective depth are pushed to the control system, the one or more task parameters, the intended effective depth, and an actual effective depth at which the control system initiates control of the drilling equipment to drill the wellbore along the desired trajectory are loggable into a trajectory log.

17. A method, comprising:

presenting, on a first human-machine interface, a plurality of selectable trajectory types, each of the trajectory types representing a potential trajectory of a wellbore;

receiving a selection, via the first human-machine interface, of a selectable trajectory type of the plurality of selectable trajectory types that most closely represents a desired trajectory of the wellbore;

pushing the selected trajectory type to a control system adapted to control drilling equipment to drill the wellbore along the desired trajectory; and based on the pushed selected trajectory type, modifying the input of at least one of a top drive, a bottom hole assembly (BHA), a drawworks, and a mud pump to change the trajectory of the wellbore from a current trajectory to the desired trajectory.

18. The method of claim 17, further comprising tracking the pushed selected trajectory type and outputting a table identifying parameters of a drilled wellbore at the time of modifying the input of at least one of the top drive, the bottom hole assembly (BHA), the drawworks, and the mud pump.

19. The method of claim 18, further comprising receiving an input, via the first human-machine interface, of one or more task parameters into one or more data fields of a task parameter needed to drill the wellbore along the desired trajectory, the input comprising at least one of: a shift distance, an inclination, a depth, and inflection data.

* * * * *